US006379022B1

(12) United States Patent
Amerson et al.

(10) Patent No.: US 6,379,022 B1
(45) Date of Patent: Apr. 30, 2002

(54) AUXILIARY ILLUMINATING DEVICE HAVING ADJUSTABLE COLOR TEMPERATURE

(75) Inventors: Frederic C Amerson, Los Altos; Paul M Hubel; Ricardo J Motta, both of Palo Alto, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/557,137

(22) Filed: Apr. 25, 2000

(51) Int. Cl.[7] ..... G21Y 9/00
(52) U.S. Cl. ..... 362/231; 362/1; 362/800
(58) Field of Search ..... 362/1, 234, 13, 362/184, 800, 11

(56) References Cited

U.S. PATENT DOCUMENTS 4,978,892 A 12/1990 Petrakos et al. ..... 315/358
5,144,190 A 9/1992 Thomas et al. ..... 313/113
5,436,535 A * 7/1995 Yang ..... 315/313
5,712,535 A 1/1998 Ogawa ..... 315/241
5,753,906 A 5/1998 Gennetten ..... 250/226
5,758,942 A * 6/1998 Fogal et al. ..... 362/12
5,803,579 A * 9/1998 Turnbull et al. ..... 362/83.1
5,851,063 A 12/1998 Doughty et al. ..... 362/231
6,095,661 A * 8/2000 Lebens et al. ..... 362/184
6,149,283 A * 11/2000 Conway et al. ..... 362/236

* cited by examiner

*Primary Examiner*—Sandra O'Shea
*Assistant Examiner*—John Anthony Ward
(74) *Attorney, Agent, or Firm*—Steven L. Webb

(57) ABSTRACT

An auxiliary illuminating device that has an adjustable color temperature. The color temperature is adjusted by varying the light output at least two independently adjustable light sources. The light source is an array of at least 2 colors. The light source typically uses at least one set of LED's.

32 Claims, 5 Drawing Sheets

AUXILIARY ILLUMINATING DEVICE HAVING ADJUSTABLE COLOR TEMPERATURE

FIELD OF THE INVENTION

The present invention relates generally to digital cameras and more specifically to an auxiliary illuminating device that has an adjustable color temperature.

BACKGROUND OF THE INVENTION

When capturing an image with a digital camera, the source of the illumination for the scene affects the colors captured with the camera. For indoor scenes the illumination source can vary widely and can include a tungsten bulb, a halogen lamp, a fluorescent lamp, sunlight coming in through a window, or even a xenon light. Each of these light sources has a different spectral energy distribution. The type of light source that creates light using a filament glowing at a high temperature (for example tungsten bulbs) are typically characterized by a color temperature defined as a Planckian radiator with a temperature 50 degrees higher than the filament of the light (see FIG. 1). The sun can also be characterized as a Planckian radiator but the loss of some wavelengths through scattering and absorption in the atmosphere causes significant differences from the Plankian radiator at those wavelengths. Because of the variation in the spectral power distribution of the sun, standard spectral power distribution curves have been developed. One of the standard curves is called D65 having a color temperature of 6500 k (see FIG. 2). Clouds in the sky can also affect the spectral distribution of energy reaching the scene from the sun. The time of day also affects the color temperature of the sun (noon vs. sunrise). The color temperature can be affected by whether the object is in direct sun light or in shadows.

The type of light source that excites a phosphor layer that then fluoresces (for example fluorescent lamps and xenon lamps) tend to have spectral distributions that are unique to the phosphors in the lamp (see FIG. 3) in combination with the mercury vapor spectrum.

Each of these light sources has a different spectral power distribution that affects the colors captured in a scene by a camera. For example when you have a white object illuminated by a tungsten bulb the white object will appear yellow in the scene captured by the camera. This is because the tungsten bulb does not produce much blue light. A white object is an object that reflects an equal amount of the red, green and blue light that hits the object. When a white object is illuminated by a tungsten bulb more red light is hitting the object than blue light and therefore more red light is reflected, causing the object to look yellow to the camera. The human eye adjusts to different illuminates and compensates for the color shift but a camera records the actual light in the scene.

Fortunately these color shifts caused by the illumination source can be corrected. This correction is typically called white balancing. Two methods are currently used to try to adjust the image to the proper white point (see U.S. Pat. No. 6,038,399).

One method looks for the brightest point in a scene and assumes that it should be white. The brightest point is adjusted until it is white and then this adjustment is used to balance the rest of the scene. This method operates on the assumption that the brightest point in a scene is from a white object or from a specular reflection, for example, the specular reflection coming from a car windshield. Another method of white balancing adjusts the image until the sum of all the areas in the image adds up to a neutral gray. Both of these methods are typically applied to the entire scene.

Applying a white balancing algorithm to the entire scene can be a problem when a flash is used in creating the image of the scene. When a flash, or auxiliary illuminating device, is used to enhance the illumination of the scene, typically the flash will not have the same color temperature as the ambient light in the scene. When a flash is used, nearby objects are illuminated by the flash more than objects that are further away. The power or intensity of the flash is typically angle dependent. This means that the flash illuminants the center of the scene more than the edges of the scene. This causes the total illumination color of each object in a scene to be dependent on the distance between the camera and the object, the angle between the object and the center of the scene and the difference in the color temperature of the ambient light and the color temperature of the flash. This makes it difficult to correct the scene for the shift in the color temperature due to the illuminant of the scene. If the color temperature of the flash could be adjusted to match the color temperature of the ambient light, then the total scene could be corrected or white balanced. Therefore there is a need for a system that can adjust the color temperature of the auxiliary illuminating device.

SUMMARY OF THE INVENTION

An auxiliary illuminating device that has an adjustable color temperature. The color temperature is adjusted by varying the light output of independently adjustable light source he light source could be an array of red, green, and blue LED's.

Other aspects and advantages of the present invention will become apparent from the following detailed description, taken in conjunction with the accompanying drawings, illustrating by way of example the principles of the invention.

DETAILED DESCRIPTION OF THE PREFERRED EMBODIMENT

A system that can adjust the color temperature of the auxiliary illuminating device used to help illuminate a scene greatly improves the color balancing of the captured scene.

Figure 4:
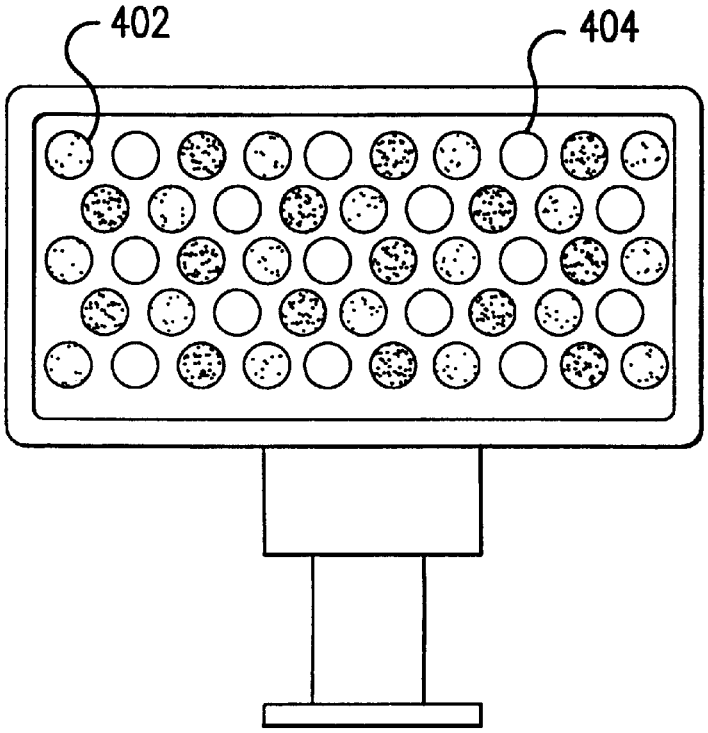
FIG. 4 is a drawing of an auxiliary illuminating device with an array of three different color LEDs in accordance with the present invention.
Figure 6:
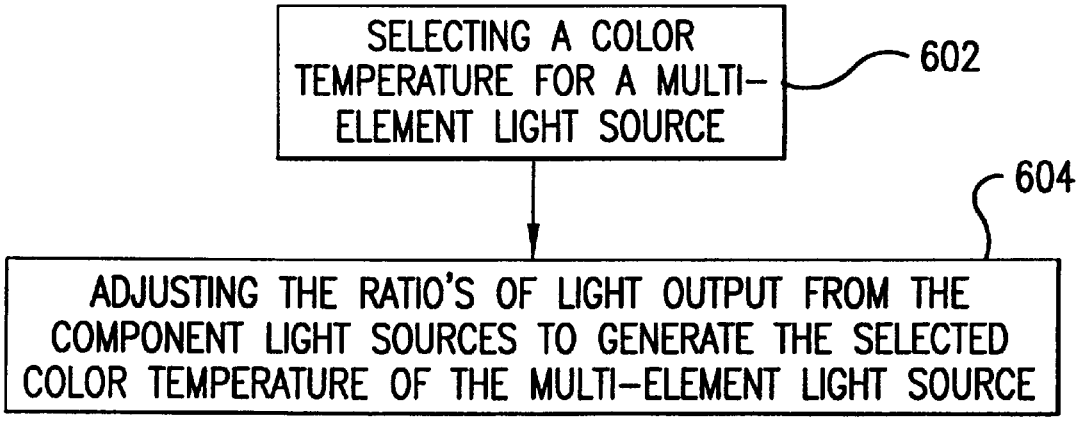
FIG. 6 is a flow chart of a method of adjusting the color temperature of a multi-element light source in accordance with the present invention.

One embodiment of the current invention comprises an array of light emitting diodes (LED). The array is made with three different color LED's (see FIG. 4). Two of the three colors are blue (402) and green (404). The third color is either red or amber. In another embodiment the array of LED's contain four colors, red, green, blue, and amber. In another embodiment a broadband light source, for example a halogen bulb, is combined with an array of LED's of a single color. In another embodiment a broadband light source, for example a halogen bulb, is combined with an array of LED's of two different colors. The array of LED's may contain multiple LED's of one color and the array may contain more of one color than another color. For example the array may contain 10 red LEDs, 10 blue LEDs and 8 green LEDs. All the LEDs of one color make up a set of LEDs. Each set of LEDs can be independently controlled as to how much light the LEDs of that set are producing. When each set of LEDs is producing a predetermined ratio of power compared to the other sets of LED's, the total light output from the LED array would be white.

For the array of LEDs to simulate the color temperature of the ambient light, the type of illumination to be matched must be known. One way is for the user to select the type of lighting from a list of choices. Another way is for the camera or an auxiliary device to measure the current light in the scene and determine the type of illumination. Once the type of illumination to be matched has been determined, the amount of light coming from each set of color LEDs is adjusted such that the total amount of light coming from the LED array is a calorimetric match to the ambient illumination source. Each type of ambient light source would typically have a different ratio of light coming from the sets of color LEDs.

Figure 1:
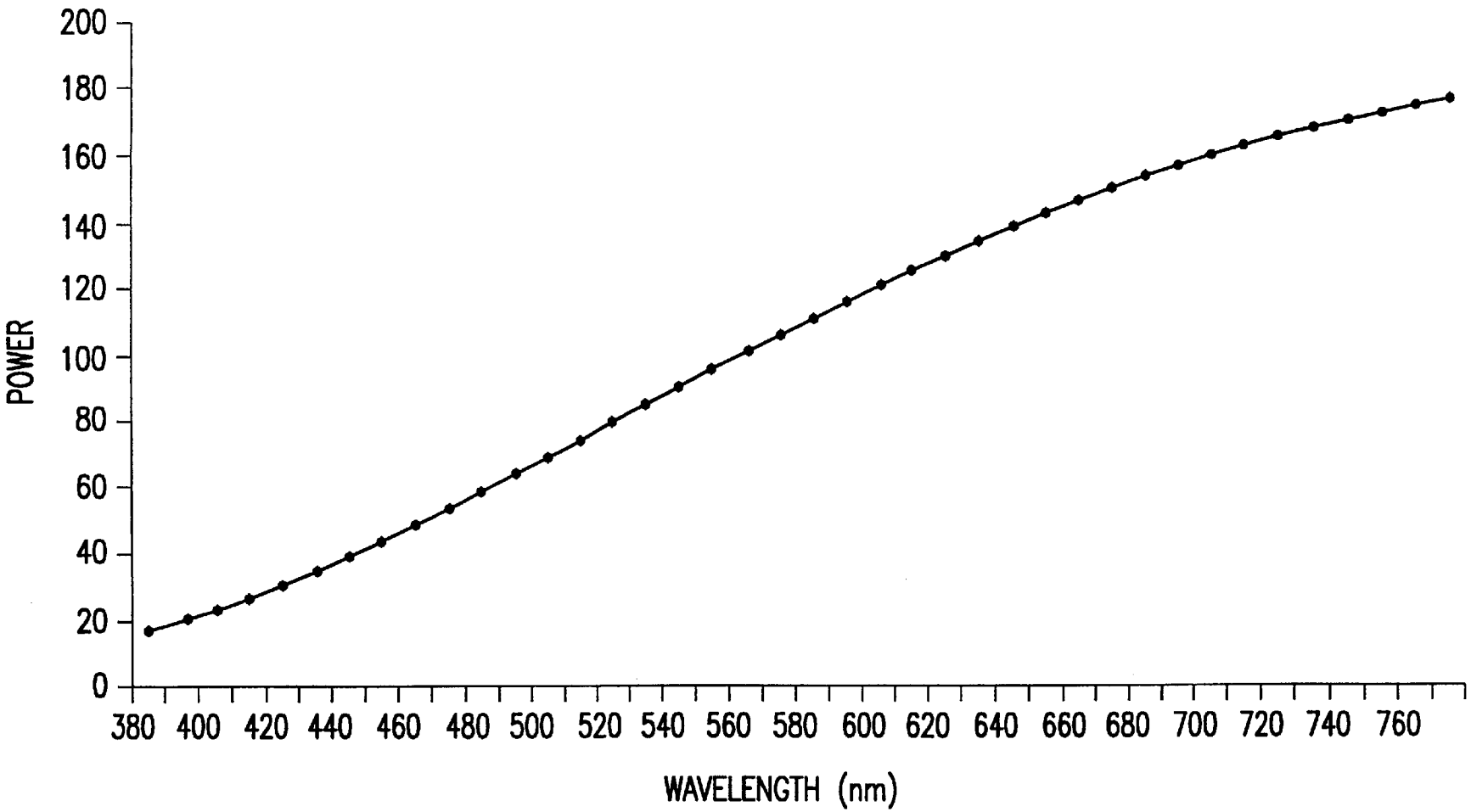
FIG. 1 is a chart of the spectral distribution of power for a tungsten bulb.
Figure 2:
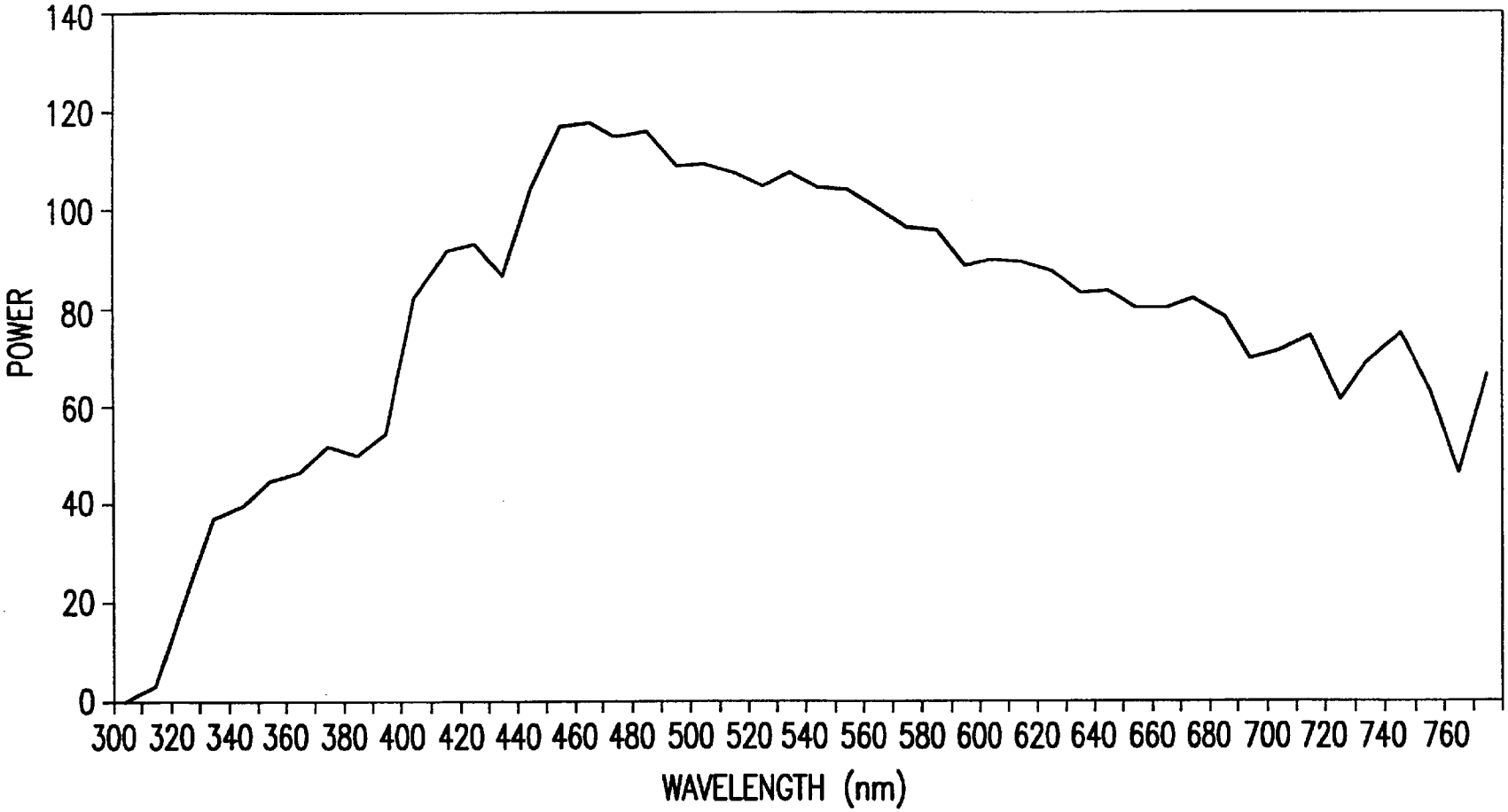
FIG. 2 is a chart of the spectral distribution of power for D65.
Figure 3:
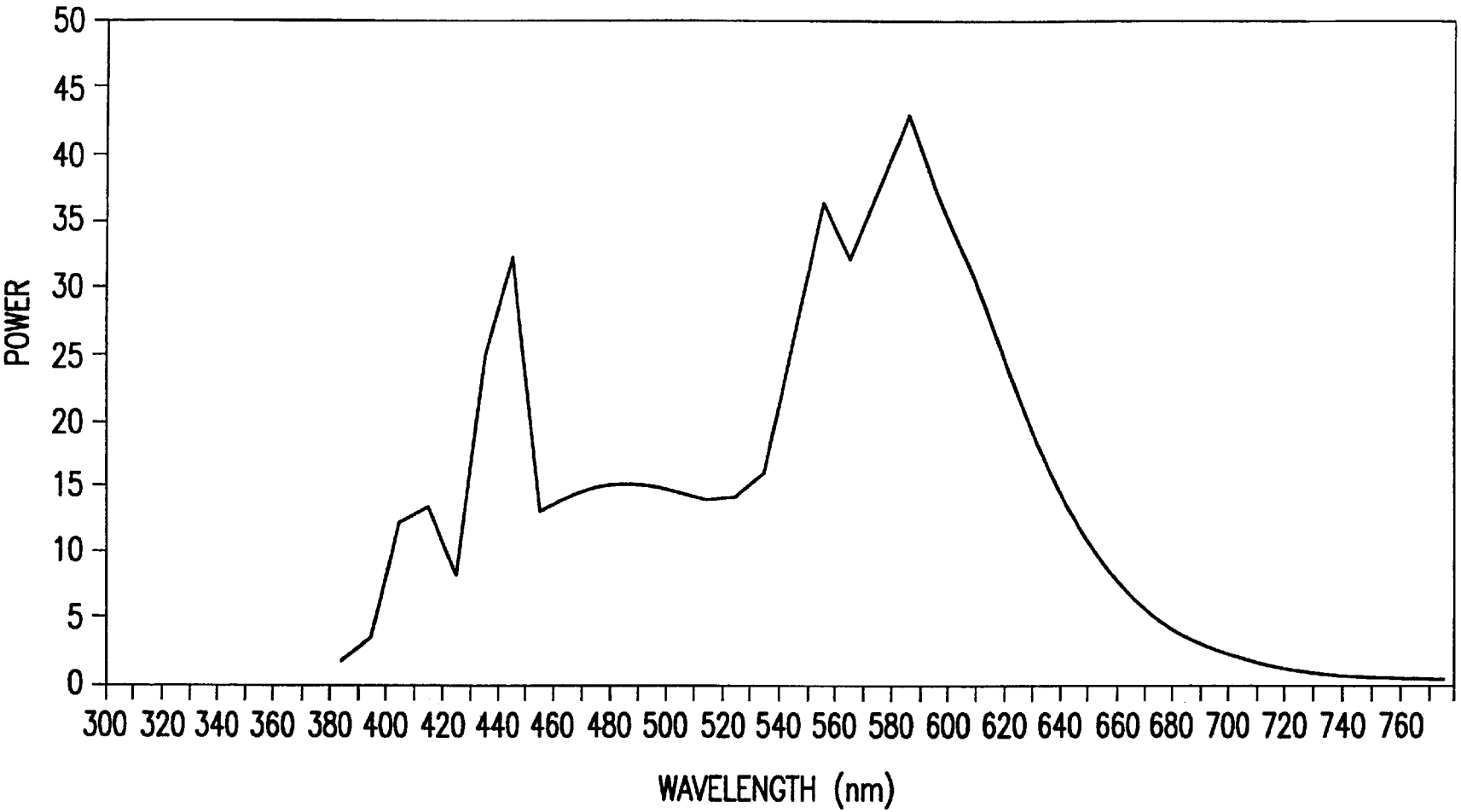
FIG. 3 is a chart of the spectral distribution of power for a florescent bulb.
Figure 5:
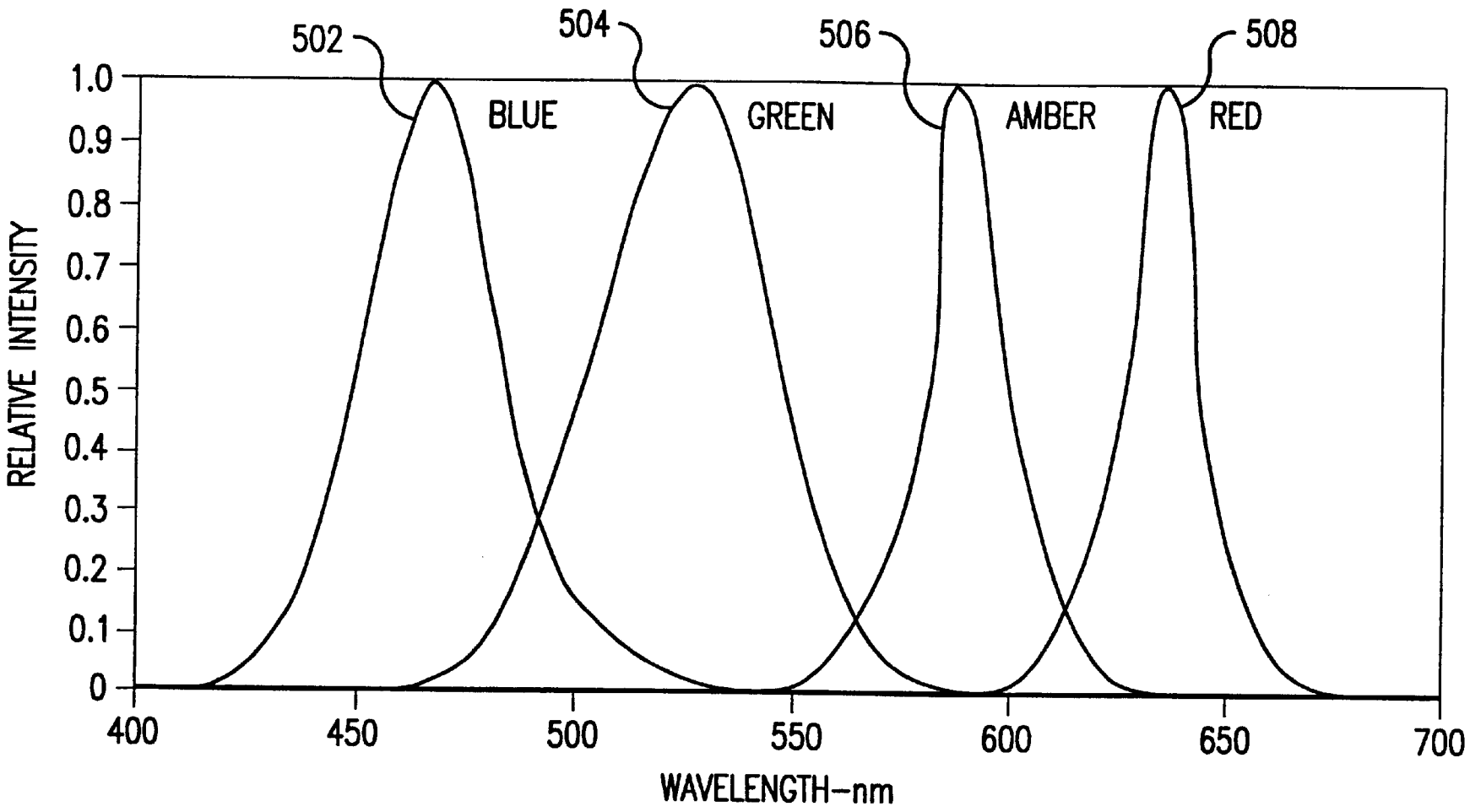
FIG. 5 is a chart of the spectral distribution of power for red, green, amber, and blue LED's.

FIG. 1 shows the spectral power distribution for a tungsten bulb with a filament temperature of 3250 K. FIG. 5 shows the spectral power distribution of 4 LEDs, a blue LED (502), a green LED (504), an amber LED (506), and a red LED (508). The ratio of power for three of the LED's from FIG. 5, for example the red, green and blue LED's, to match an ambient light source can be calculated with the following equations. Using standard calorimetric formulas (well know in the art), the chromaticity of the ambient light source is calculated, for example $x_0$=0.4202 and $y_0$=0.3976 where $x_0$ and $y_0$ are the chromaticity coordinates of the ambient light source. Matching the given chromaticity coordinates can be done by determining the CIE tristimulus values X, Y, Z. The tristimulus values are calculated from the tristimulus functions X(λ), Y(λ), Z(λ) and the total output power from the LED arrays. The power from the LED arrays is represented by the spectral output distribution of the three LED arrays $R_{LED}(\lambda)$, $G_{LED}(\lambda)$, $B_{LED}(\lambda)$ and a multiplier for each array $E_1$, $E_2$, and $E_3$.

$$X=\int X(\lambda)(E_1R_{led}(\lambda)+E_2G_{led}(\lambda)+E_3B_{led}(\lambda))d\lambda \quad \text{Equation 1}$$

$$Y=\int Y(\lambda)(E_1R_{led}(\lambda)+E_2G_{led}(\lambda)+E_3B_{led}(\lambda))d\lambda \quad \text{Equation 2}$$

$$Z=\int Z(\lambda)(E_1R_{led}(\lambda)+E_2G_{led}(\lambda)+E_3B_{led}(\lambda))d\lambda \quad \text{Equation 3}$$

Where the integral is evaluated over the visible spectrum, for example 350 nm to 780 nm. From these equations the chromaticity coordinates of the LED arrays can be calculated as:

$$y=\frac{Y}{X+Y+Z} \quad \text{Equation 4}$$

$$x=\frac{X}{X+Y+Z} \quad \text{Equation 5}$$

Because we are interested in the relative power of each LED set, we can say that:

$$E_1+E_2+E_3=1 \quad \text{Equation 6}$$

Equations 1, 2 and 3 are then substituted into equation 4 and 5. Therefore it can be shown that the chromaticity coordinates of the LED arrays can be expressed in terms of $E_1$ and $E_2$:

$$x(E_1,E_2)=x_0$$

$$y(E_1,E_2)=y_0$$

Where $x_0$ and $y_0$ are the desired chromitisity coordinates of the ambient light. The Newton-Raphson method (discribed in "Numerical regresion: the art of scientific computing" by W. H. Press, B. P. Flannery, S. A. Peukoastky, and W. T. Vetterling, Cambrige University Press 1988) can be generalized in the 2D case as follows:

$$\begin{bmatrix} x_n-x_0 \\ y_n-y_0 \end{bmatrix} = \begin{bmatrix} \frac{\partial x_n}{\partial E_{1,n}} & \frac{\partial x_n}{\partial E_{2,n}} \\ \frac{\partial y_n}{\partial E_{1,n}} & \frac{\partial y_n}{\partial E_{2,n}} \end{bmatrix} \begin{bmatrix} E_{1,n}-E_{1,n+1} \\ E_{2,n}-E_{2,n+1} \end{bmatrix}$$

For the $n^{th}$ itteration the partial derivitive $x_n$ and $y_n$ with respect to $E_{1,n}$ and $E_{2,n}$ are calculated numericly. This gives new values of $E_1$ and $E_2$ based on a first aproximation of $E_1$ and $E_2$. Inverting the matrix gives the next value of $E_1$ and $E_2$ $$\begin{bmatrix} E_{1,n}-E_{1,n+1} \\ E_{2,n}-E_{2,n+1} \end{bmatrix} = \frac{1}{\frac{\partial x_n}{\partial E_{1,n}} * \frac{\partial y_n}{\partial E_{2,n}} - \frac{\partial x_n}{\partial E_{2,n}} * \frac{\partial y_n}{\partial E_{1,n}}} \begin{bmatrix} \frac{\partial y_n}{\partial E_{2,n}} & -\frac{\partial y_n}{\partial E_{1,n}} \\ -\frac{\partial x_n}{\partial E_{2,n}} & \frac{\partial x_n}{\partial E_{1,n}} \end{bmatrix} \begin{bmatrix} x_n-x_0 \\ y_n-y_0 \end{bmatrix}$$

Which is iterated until the total change in $E_1$ and $E_2$ is less than a predetermined error amount, for example 0.0001. The ratio of power for the LED arrays calculated using the above method gives a visual (or calorimetric) match between the LEDs' light and the ambient light. In most cases this would be adequate for use as the strobe setting for a camera. Further improvement could be achieved by tailoring the calculations and resulting LED power ratio's to the specific spectral sensitivity of the camera. In camera design it is a goal to have the spectral sensitivities be a linear transform of the color matching functions (X(λ), Y(λ), Z(λ)) but due to signal-to-noise and design constraints it is never precisely reached. It is desirable then to have the LED illumination match the signal received by a camera from the ambient light. This will give a color match as seen by the camera that will differ slightly from the match designed for a human observer (i.e. a colorimetric match). For a match as seen by the camera the analysis is repeated as above except the color matching functions (X(λ), Y(λ), Z(λ)) are replaced with the camera specific spectral sensitivity functions. Using the camera spectral sensitivity functions will result in the correct power ratios for the LEDs to match the color from the ambient light that the camera detects.

The power ratio's created using the visual (or calorimetric) match calculated with the CIE color matching functions (X(λ), Y(λ), Z(λ)) results in a generic flash. The generic flash can be used interchangeably between cameras that have different spectral sensitivities. The difference in spectral sensitivity between cameras can be caused by different CCD designs and/or different color filter pass bands. The power ratio's created using the camera specific spectral sensitivity functions would work best with the camera they were designed for.

The method used above could also be used for determining the power ratio of two sources, for example a red and a blue LED. The method would also work with a broad band light source and a narrow band light source, for example an LED and a halogen light source. With only two light sources the light may not be able to match exactly the ambient source. The two sources could be chosen to maximize the number of ambient light sources or the two sources could be chosen such that a very close match exist for a specific ambient light source. The form of the equation for a broad band light source B and a narrow band light source N would be as follows:

$$X=\int X(\lambda)(E_1 B(\lambda)+E_2 N(\lambda))d\lambda$$

Where B(λ) is the spectral power of the broadband light source and N(λ) is the spectral power of the narrowband light source.

For an adjustable light source with 4 light source components the power ratio between the 4 light sources can be determined using well known numerical methods.

The auxiliary illuminating device would contain a table or list of the correct power ratios for a number of ambient sources.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A multi-element light source with an adjustable color temperature, comprising:

a first light source, the first light source producing light over a first wavelength band;

a second light source, the second light source producing light over a second wavelength band;

a control system, the control system able to adjust the ratio of light produced by the two light sources, the control system configured to switch between at least two preset ratios of light where each preset ratio corresponds to a different color temperature, and where both the at least two preset ratios have both light sources producing light.

2. The multi-element light source of claim 1 where at least one of the light sources is an LED.

3. The multi-element light source of claim 1 where at least one of the wavelength bands is narrow.

4. The multi-element light source of claim 1 were the multi-element light source is powered by a battery.

5. The multi-element light source of claim 1 where the multi-element light source is portable.

6. The multi-element light source of claim 1 where the multi-element light source is configured to mount on a camera.

7. A multi-element light source with an adjustable color temperature, comprising:

a first light source, the first light source producing light over a first wavelength band;

a second light source, the second light source producing light over a second wavelength band;

a third light source, the third light source producing light over a third wavelength band;

a control system, the control system able to adjust the ratio of light produced by the three light sources, the control system configured to switch between at least two preset ratios of light where each preset ratio corresponds to a different color temperature, and where both the at least two preset ratios have all three light sources producing light.

8. The multi-element light source of claim 7 where at least one of the wavelength bands of the light sources is narrow.

9. The multi-element light source of claim 7 where the first light source produces red light, the second light source produces green light, and the third light source produces blue light.

10. The multi-element light source of claim 7 where the first light source produces amber light, the second light source produces green light, and the third light source produces blue light.

11. The multi-element light source of claim 7 where at least one of the light sources is an LED.

12. The multi-element light source of claim 7 were the multi-element light source is powered by a battery.

13. The multi-element light source of claim 7 where the multi-element light source is portable.

14. The multi-element light source of claim 7 where the multi-element light source is configured to mount on a camera.

15. The multi-element light source of claim 7 further comprising:

a fourth light source, the fourth light source producing light over a fourth wavelength band.

16. A method of adjusting the color temperature of a multi-element light source, comprising:

determining the color temperature of the ambient light in a scene;

selecting a color temperature for the multi-element light source (602) that most closely matches the color temperature of the ambient light in the scene;

adjusting the ratio of light outputs of a first light source component with respect to the light output of a second light source component such that the ratio of the light outputs of the two light source components generates the color temperature for the multi-element light source, the first light source component producing light over a first wavelength band and the second light source component producing light over a second wavelength band;

repeating the above steps for a different scene.

17. The method of claim 16 where one of the light source components is a light emitting diode (LED).

18. A method of adjusting the color temperature of a multi-element light source, comprising:

determining the color temperature of the ambient light in a scene;

selecting a color temperature for the multi-element light source that most closely matches the color temperature of the ambient light in the scene;

adjusting the light output of a first light source, the first light source producing light over a first wavelength band;

adjusting the light output of a second light source, the second light source producing light over a second wavelength band;

adjusting the light output of a third light source, the third light source producing light over a third wavelength band, such that the ratio of the light output of the three light sources generates the color temperature of the desired multi-element light source.

19. The method of claim 16 where at least one of the light sources is a light emitting diode (LED).

20. The method of claim 16 where one of the LED's is a red LED, one of the LED's is a green LED, and one of the LED's is a blue LED.

21. The method of claim 20 where one of the LED's is an amber LED, one of the LED's is a green LED, and one of the LED's is a blue LED.

22. A method of adjusting the color temperature of a multi-element light source, comprising:

determining the color temperature of the ambient light in a scene;

selecting a color temperature for the multi-element light source that most closely matches the color temperature of the ambient light in the scene;

adjusting the light output of a first light source, the first light source producing light over a first wavelength band;

adjusting the light output of a second light source, the second light source producing light over a second wavelength band;

adjusting the light output of a third light source, the third light source producing light over a third wavelength band;

adjusting the light output of a fourth light source, the fourth light source producing light over a fourth wavelength band, such that the ratio of the light output of the four light sources generates the color temperature of the desired multi-element light source.

23. The method of claim 16 where the ambient light in the scene is measured to determination of the color temperature the ambient light in the scene.

24. The method of claim 16 where selecting a choice from a list of light sources determines the color temperature of the ambient light in the scene.

25. The method of claim 18 where the ambient light in the scene is measured to determination of the color temperature the ambient light in the scene.

26. The method of claim 18 where selecting a choice from a list of light sources determines the color temperature of the ambient light in the scene.

27. The method of claim 22 where the ambient light in the scene is measured to determination of the color temperature the ambient light in the scene.

28. The method of claim 22 where selecting a choice from a list of light sources determines the color temperature of the ambient light in the scene.

29. A multi-element light source with an adjustable color temperature, comprising:

a first light source, the first light source producing light over a first wavelength band;

a second light source, the second light source producing light over a second wavelength band;

a control system, the control system able to adjust the ratio of light produced by the two light sources, the control system configured to switch between at least two preset ratios of light where each preset ratio corresponds to a different color temperature, and where one of the at least two preset ratios corresponds to the color temperature of an incandescent light.

30. The multi-element light source of claim 29 where at least one of the light sources is an LED.

31. A multi-element light source with an adjustable color temperature, comprising:

a first light source, the first light source producing light over a first wavelength band;

a second light source, the second light source producing light over a second wavelength band;

a control system, the control system able to adjust the ratio of light produced by the two light sources, the control system configured to switch between at least two preset ratios of light where each preset ratio corresponds to a different color temperature, and where one of the at least two preset ratios corresponds to the color temperature of a fluorescent light.

32. The multi-element light source of claim 31 where at least one of the light sources is an LED.

* * * * *